US006976298B1

(12) United States Patent
Pietras

(10) Patent No.: US 6,976,298 B1
(45) Date of Patent: Dec. 20, 2005

(54) METHODS AND APPARATUS FOR CONNECTING TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/762,699

(22) PCT Filed: Aug. 16, 1999

(86) PCT No.: PCT/GB99/02710

§ 371 (c)(1),
(2), (4) Date: May 10, 2001

(87) PCT Pub. No.: WO00/11311

PCT Pub. Date: Mar. 2, 2000

(30) Foreign Application Priority Data

Aug. 24, 1998 (GB) ..... 9818363

(51) Int. Cl.[7] ..... B23P 11/00; E21B 19/18

(52) U.S. Cl. ..... 29/428; 29/456; 29/464; 29/468; 29/281.5; 166/77.51; 166/77.52; 166/380

(58) Field of Search ..... 29/252, 281.6, 29/281.5, 281.4, 428, 456, 464, 468, 77.52; 269/54.3, 156, 157, 164, 265, 287, 288, 17, 269/37; 228/49.3; 166/77.51, 77.52, 380

(56) References Cited

U.S. PATENT DOCUMENTS

| | | | | |
|---|---|---|---|---|
| 1,917,135 A | | 7/1933 | Littell | |
| 3,041,901 A | | 7/1962 | Knights | 81/53 |
| 3,193,116 A | | 7/1965 | Kenneday et al. | 214/2.5 |
| 3,380,528 A | | 4/1968 | Timmons | 166/14 |
| 3,566,505 A | * | 3/1971 | Martin | 228/49.3 |
| 3,570,598 A | | 3/1971 | Johnson | 166/178 |
| 3,635,105 A | | 1/1972 | Dickmann et al. | 81/57.18 |
| 3,691,825 A | | 9/1972 | Dyer | 73/136 |
| 3,747,675 A | | 7/1973 | Brown | 166/237 |
| 3,766,991 A | | 10/1973 | Brown | 173/20 |
| 3,776,320 A | | 12/1973 | Brown | 173/163 |
| 3,848,684 A | | 11/1974 | West | 175/195 |
| 3,857,450 A | | 12/1974 | Guler | 175/85 |
| 3,913,687 A | | 10/1975 | Gyongyosi et al. | 175/85 |
| 4,100,968 A | | 7/1978 | Delano | 166/315 |
| 4,320,915 A | | 3/1982 | Abbott et al. | 294/96 |
| 4,437,363 A | | 3/1984 | Haynes | 81/57.18 |
| 4,449,596 A | | 5/1984 | Boyadjieff | 175/85 |
| 4,489,794 A | | 12/1984 | Boyadjieff | 175/85 |
| 4,494,424 A | | 1/1985 | Bates | 81/57.18 |
| 4,529,045 A | | 7/1985 | Boyadjieff et al. | 173/164 |
| 4,570,706 A | | 2/1986 | Pugnet | 166/77.5 |

(Continued)

FOREIGN PATENT DOCUMENTS

| | | | | |
|---|---|---|---|---|
| EP | 0162000 A1 | * | 11/1985 | E21B 19/16 |

(Continued)

OTHER PUBLICATIONS

LaFleur Petroleum Services, Inc., "Autoseal Circulating Head," Engineering Manufacturing, 1992, 11 Pages.

(Continued)

*Primary Examiner*—Essama Omgba
(74) *Attorney, Agent, or Firm*—Moser, Patterson & Sheridan, I

(57) ABSTRACT

An apparatus for facilitating the connection of tubulars using a top drive, the apparatus comprising a stator attachable to said top drive, and a supporting member for supporting a tool, wherein means are provided to allow substantially horizontal movement of said supporting member.

24 Claims, 7 Drawing Sheets

U.S. PATENT DOCUMENTS

| | | | | | |
|---|---|---|---|---|---|
| 4,593,773 | A | | 6/1986 | Skeie | 175/85 |
| 4,604,724 | A | | 8/1986 | Shaginian et al. | 364/478 |
| 4,605,077 | A | | 8/1986 | Boyadjieff | 175/85 |
| 4,625,796 | A | | 12/1986 | Boyadjieff | 166/77.5 |
| 4,649,777 | A | | 3/1987 | Buck | 81/57.19 |
| 4,676,312 | A | | 6/1987 | Mosing et al. | 166/77 |
| 4,683,962 | A | | 8/1987 | True | 173/163 |
| 4,709,599 | A | | 12/1987 | Buck | 81/57.18 |
| 4,742,876 | A | * | 5/1988 | Barthelemy et al. | 175/189 |
| 4,754,807 | A | | 7/1988 | Lange | 166/236 |
| 4,759,239 | A | | 7/1988 | Hamilton et al. | 81/57.34 |
| 4,762,187 | A | | 8/1988 | Haney | 175/171 |
| 4,765,401 | A | | 8/1988 | Boyadjieff | 166/77.53 |
| 4,773,689 | A | | 9/1988 | Wolters | 294/88 |
| 4,791,997 | A | | 12/1988 | Krasnov | 175/57 |
| 4,793,422 | A | * | 12/1988 | Krasnov | 175/57 |
| 4,800,968 | A | | 1/1989 | Shaw et al. | 175/85 |
| 4,813,493 | A | * | 3/1989 | Shaw et al. | 173/164 |
| 4,815,546 | A | * | 3/1989 | Haney et al. | 173/197 |
| 4,836,064 | A | | 6/1989 | Slator | 81/57.18 |
| 4,867,236 | A | | 9/1989 | Haney et al. | 166/77.5 |
| 4,878,546 | A | | 11/1989 | Shaw et al. | 173/163 |
| 4,997,042 | A | | 3/1991 | Jordan et al. | 166/379 |
| 5,009,265 | A | | 4/1991 | Bailey et al. | 166/118 |
| 5,036,927 | A | | 8/1991 | Willis | 175/162 |
| 5,191,939 | A | | 3/1993 | Stokley | 166/379 |
| 5,251,709 | A | | 10/1993 | Richardson | 175/220 |
| 5,255,751 | A | | 10/1993 | Stogner | 175/203 |
| 5,297,833 | A | | 3/1994 | Willis et al. | 294/102.2 |
| 5,351,767 | A | | 10/1994 | Stogner et al. | 175/162 |
| 5,388,651 | A | * | 2/1995 | Berry | 175/85 |
| 5,433,279 | A | * | 7/1995 | Tessari et al. | 173/147 |
| 5,501,286 | A | * | 3/1996 | Berry | 175/52 |
| 5,503,234 | A | | 4/1996 | Clanton | 175/52 |
| 5,553,672 | A | | 9/1996 | Smith, Jr. et al. | 166/382 |
| 5,575,344 | A | * | 11/1996 | Wireman | 175/85 |
| 5,577,566 | A | | 11/1996 | Albright et al. | 175/321 |
| 5,584,343 | A | | 12/1996 | Coone | 166/387 |
| 5,645,131 | A | | 7/1997 | Trevisani | 175/171 |
| 5,735,348 | A | | 4/1998 | Hawkins, III | 166/285 |
| 5,791,410 | A | | 8/1998 | Castille et al. | 166/77.1 |
| 5,803,191 | A | | 9/1998 | Mackintosh | 175/170 |
| 5,836,395 | A | | 11/1998 | Budde | 166/321 |
| 5,850,766 | A | * | 12/1998 | Stokes | 81/57.34 |
| 5,909,768 | A | | 6/1999 | Castille et al. | 166/77.1 |
| 5,971,079 | A | | 10/1999 | Mullins | 166/387 |
| 6,000,472 | A | | 12/1999 | Albright et al. | 166/380 |
| 6,056,060 | A | | 5/2000 | Abrahamsen et al. | 166/380 |
| 6,070,500 | A | | 6/2000 | Dlask et al. | 81/57.33 |
| 6,199,641 | B1 | | 3/2001 | Downie et al. | 175/55 |
| 6,309,002 | B1 | | 10/2001 | Bouligny | 294/86.25 |
| 6,311,792 | B1 | | 11/2001 | Scott et al. | 175/162 |
| 6,349,764 | B1 | | 2/2002 | Adams et al. | 166/77.53 |
| 6,360,633 | B2 | | 3/2002 | Pietras | 81/57.34 |
| 6,412,554 | B1 | | 7/2002 | Allen et al. | 166/80.1 |
| 6,431,626 | B1 | | 8/2002 | Bouligny | 294/86.25 |
| 6,527,047 | B1 | * | 3/2003 | Pietras | 166/77.51 |
| 6,536,520 | B1 | * | 3/2003 | Snider et al. | 166/78.1 |
| 6,550,128 | B1 | * | 4/2003 | Lorenz | 29/464 |
| 6,622,796 | B1 | * | 9/2003 | Pietras | 166/379 |
| 6,679,333 | B2 | * | 1/2004 | York et al. | 166/379 |
| 6,688,398 | B2 | * | 2/2004 | Pietras | 166/380 |
| 6,705,405 | B1 | * | 3/2004 | Pietras | 166/380 |
| 6,725,938 | B1 | * | 4/2004 | Pietras | 166/380 |
| 2001/0042625 | A1 | * | 11/2001 | Appleton | 166/379 |
| 2002/0134555 | A1 | | 9/2002 | Allen et al. | 166/377 |
| 2002/0170720 | A1 | * | 11/2002 | Haugen | 166/379 |
| 2003/0111233 | A1 | * | 6/2003 | Pietras | 166/380 |
| 2004/0069500 | A1 | * | 4/2004 | Haugen | 166/380 |
| 2004/0149451 | A1 | * | 8/2004 | Pietras | 166/380 |
| 2004/0173357 | A1 | * | 9/2004 | Pietras | 166/380 |
| 2004/0194965 | A1 | * | 10/2004 | Pietras | 166/379 |

FOREIGN PATENT DOCUMENTS

| | | | |
|---|---|---|---|
| EP | 0 171 144 A1 | 2/1986 | E21B 19/06 |
| EP | 0 285 386 A2 | 10/1988 | E21B 19/16 |
| EP | 0 525 247 A1 | 2/1993 | E21B 3/02 |
| EP | 0 589 823 A1 | 3/1994 | E21B 19/06 |
| EP | 0 659 975 | 6/1995 | E21B 43/08 |
| GB | 2 167 790 | 6/1986 | E21B 19/00 |
| GB | 2 224 481 A | 9/1990 | B66C 1/56 |
| GB | 2 275 486 A | 4/1993 | E21B 37/00 |
| GB | 2 357 530 A | 6/2001 | E21B 19/07 |
| WO | WO 93/07358 | 4/1993 | E21B 37/00 |
| WO | WO 96/18799 | 6/1996 | E21B 19/06 |
| WO | 97/17524 | 5/1997 | E21B 43/08 |
| WO | WO 98/05844 | 2/1998 | E21B 19/16 |
| WO | WO 98/11322 | 3/1998 | E21B 19/16 |
| WO | 98/22690 | 5/1998 | E21B 17/08 |
| WO | 98/32948 | 7/1998 | E21B 19/16 |
| WO | WO 00/05483 | 3/2000 | E21B 19/16 |
| WO | WO 00/11309 | 3/2000 | E21B 19/16 |
| WO | WO 00/11310 | 3/2000 | E21B 19/16 |
| WO | WO 00/11311 | 3/2000 | E21B 19/16 |
| WO | WO 00/39429 | 7/2000 | E21B 19/16 |
| WO | WO 00/39430 | 7/2000 | E21B 19/16 |

OTHER PUBLICATIONS

Valves Wellhead Equipment Safety Systems, W-K-M Division, ACF Industries, Catalog 80, 1980, 5 Pages.

"Canrig Top Drive Drilling Systems," Harts Petroleum Engineer International, Feb. 1997, 2 Pages.

"The Original Portable Top Drive Drilling System," TESCO Drilling Technology, 1997.

Killalea, Mike, "Portable Top Drives: What's Driving The Market?" IADC, Drilling Contractor, Sep. 1994, 4 Pages.

"500 or 650 ECIS Top Drive," Advanced permanent Magnet Motor Technology, TESCO Drilling Technology, Apr. 1998, 2 Pages.

"500 or 650 HCIS Top Drive," Powerful Hydraulic Compact Top Drive Drilling System, TESCO Drilling Technology, Apr. 1998, 2 Pages.

"Product Information (Sections 1-10)," CANRIG Drilling Technology, Ltd. Sep. 18, 1996.

Norwegian Search Report, Norwegian Patent Application No. 2001 0564, dated Sep. 4, 2003.

* cited by examiner 12
13
11
15
30
18
16
28
31
19
29
1
22
32
26
24
X
20
4
40

METHODS AND APPARATUS FOR CONNECTING TUBULARS USING A TOP DRIVE

BACKGROUND OF THE INVENTION

1. Field of the Invention

This invention relates to methods and apparatus for facilitating the connection of tubulars using a top drive and is more particularly, but not exclusively for facilitating the connection of a section or stand of casing to a string of casing.

2. Description of the Related Art

In the construction of wells such as oil or gas wells, it is usually necessary to line predrilled holes with a string of tubulars known as casing. Because of the size of the casing required, sections or stands of say two sections of casing are connected to each other as they are lowered into the well from a platform. The first section or stand of casing is lowered into the well and is usually restrained from falling into the well by a spider located in the platform's floor. Subsequent sections or stands of casing are moved from a rack to the well centre above the spider. The threaded pin of the section or stand of casing to be connected is located over the threaded box of the casing in the well to form a string of casing. The connection is made-up by rotation therebetween.

It is common practice to use a power tong to torque the connection up to a predetermined torque in order to perfect the connection. The power tong is located on the platform, either on rails, or hung from a derrick on a chain. However, it has recently been proposed to use a top drive for making such connection either alone or in combination with a power tong.

It has been observed that sections or stands of tubulars are often not as uniform as desired. In particular, the sections or stands of tubulars are often not straight. The top drive is in perfect alignment with the centre of the spider in the platform of an oil or gas rig. However, a section or stand of tubulars located in the spider would not always be in alignment with the top drive.

SUMMARY OF THE INVENTION

According to a first aspect of the present invention there is provided an apparatus for facilitating the connection of tubulars using a top drive, the apparatus comprising a stator attachable to said top drive, and a supporting member for supporting a tool wherein means are provided to allow substantially horizontal movement of said supporting member.

According to a second aspect of the present invention there is provided a method for facilitating the connection of tubulars using a top drive, the method comprising the steps of attaching a tool to the top drive using a supporting member and adjusting the supporting member to cause the tool to be displaced horizontally relative to the top drive.

BRIEF DESCRIPTION OF THE DRAWINGS

For a better understanding of the present invention and in order to show how the same may be carried into effect reference will now be made, by way of example, to the accompanying drawings, in which.

DETAILED DESCRIPTION OF THE PREFERRED EMBODIMENTS

Figure 1:
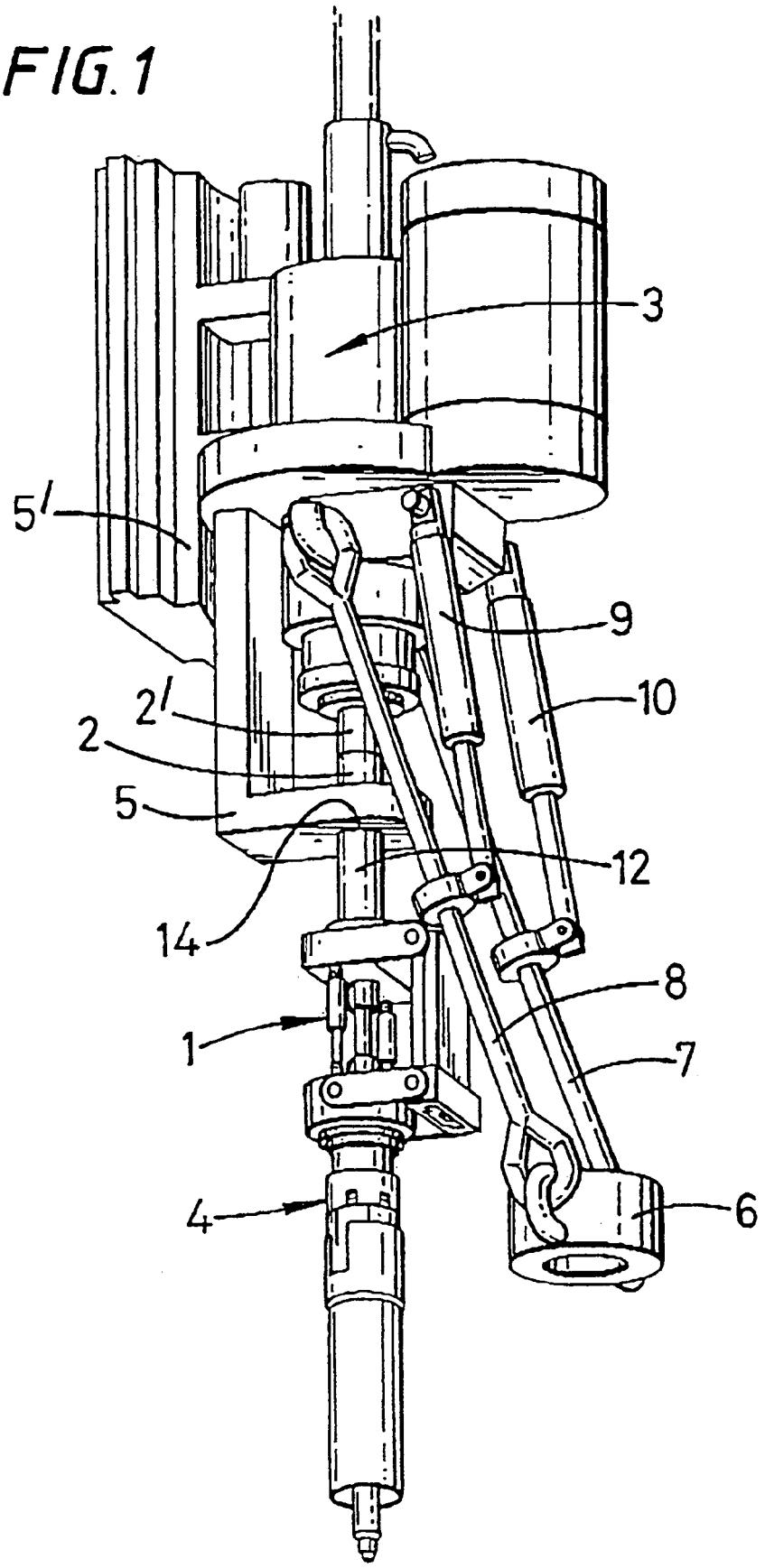
FIG. 1 is a side view in perspective of an apparatus in accordance with an embodiment of the invention in use.

Referring to FIG. 1 there is shown an apparatus which is generally identified by reference numeral 1.

The apparatus I depends from a rotor 2' of a top drive 3. A tool 4 for gripping a tubular depends from the lower end of the apparatus 1. A rigid guide member 5 is provided to guide the rotor 2 of the apparatus 1. The rigid guide member 5 is fast with a stator 5' of the top drive 3. The rotor 2' of the top drive 3 is coupled by a threaded connection to the rotor 2 of the apparatus 1. The rigid guide member 5 may be provided with a clamp for clamping the rotor 2 of the apparatus I so that the threaded connection to the rotor 2' of the top drive 3 can be made, after which the clamp would be released.

An elevator 6 is provided on the end of bails 7, 8 which are hung from the top drive 3. Piston and cylinders 9, 10 are arranged between the bails 7, 8 and the top drive 3 for moving the elevator 6 from below the top drive 3 to an out of the way position.

Figure 2:
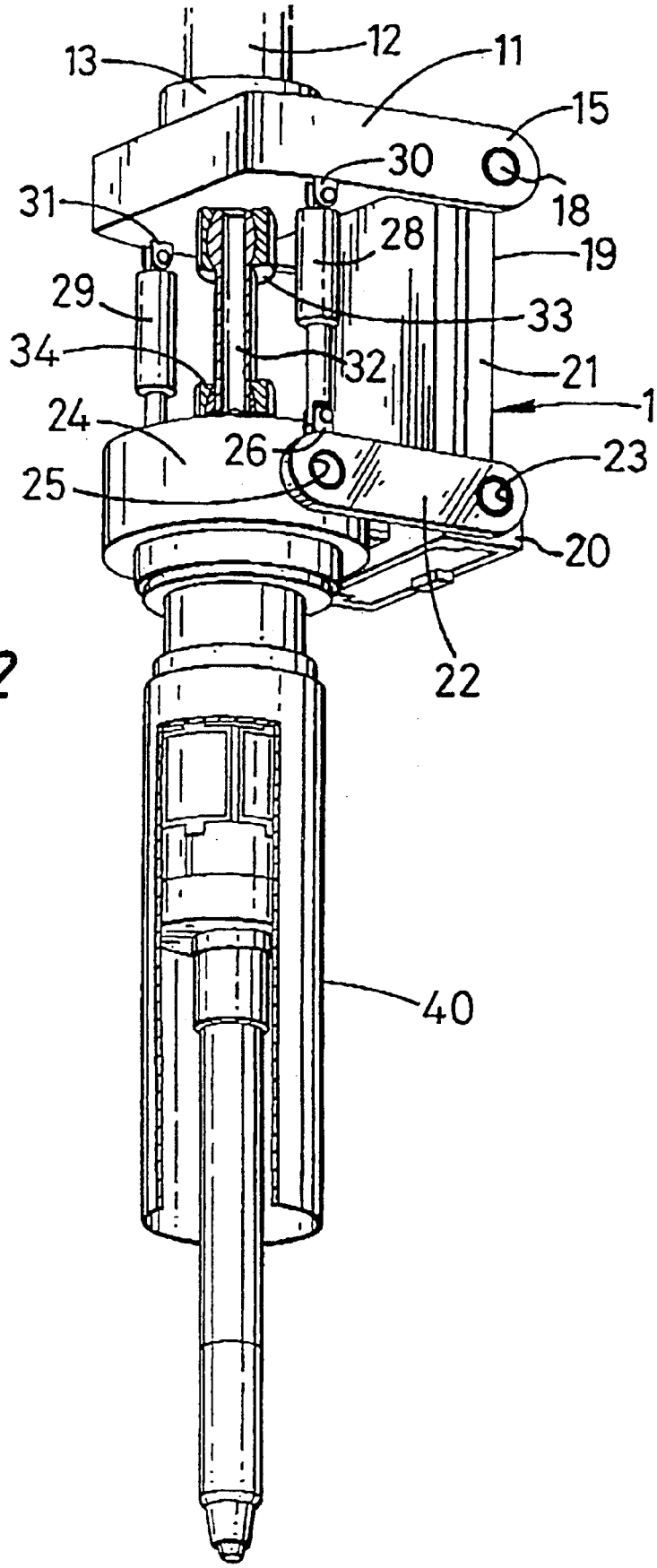
FIG. 2 is an enlarged view of parts of FIG. 1, with parts inserted in a tubular and with parts cut away.

Referring now to FIG. 2, there is shown the apparatus 1 which comprises a plate 11 which is fixed to a connecting tubular 12 by a collar 13. The connecting tubular 12 passes through a hole 14 in rigid body 5 and connects with the rotor 2 (FIG. 1). The plate 11 has two projections 15 and 16 which have holes 17 for accommodating axles 18 which are rotationally disposed therein. The axles 18 are integral with a rigid body 19. A slider 20 is arranged on runners 21 on either side of the rigid body 19. Arms 22 are connected at one end to the slider 20 via spherical bearings 23.

The other end of arms 22 are connected to a supporting member 24 via spherical bearings 25.

The arms 22 and are provided with lugs 26 to which one end of a piston and cylinder 28 and 29 is attached and are movable thereabout. The other end of each piston and cylinder 28 and 29 is attached to lugs 30 and 31 and is movable thereabout. The lugs 30 and 31 are fixed to plate 11.

Figure 3:
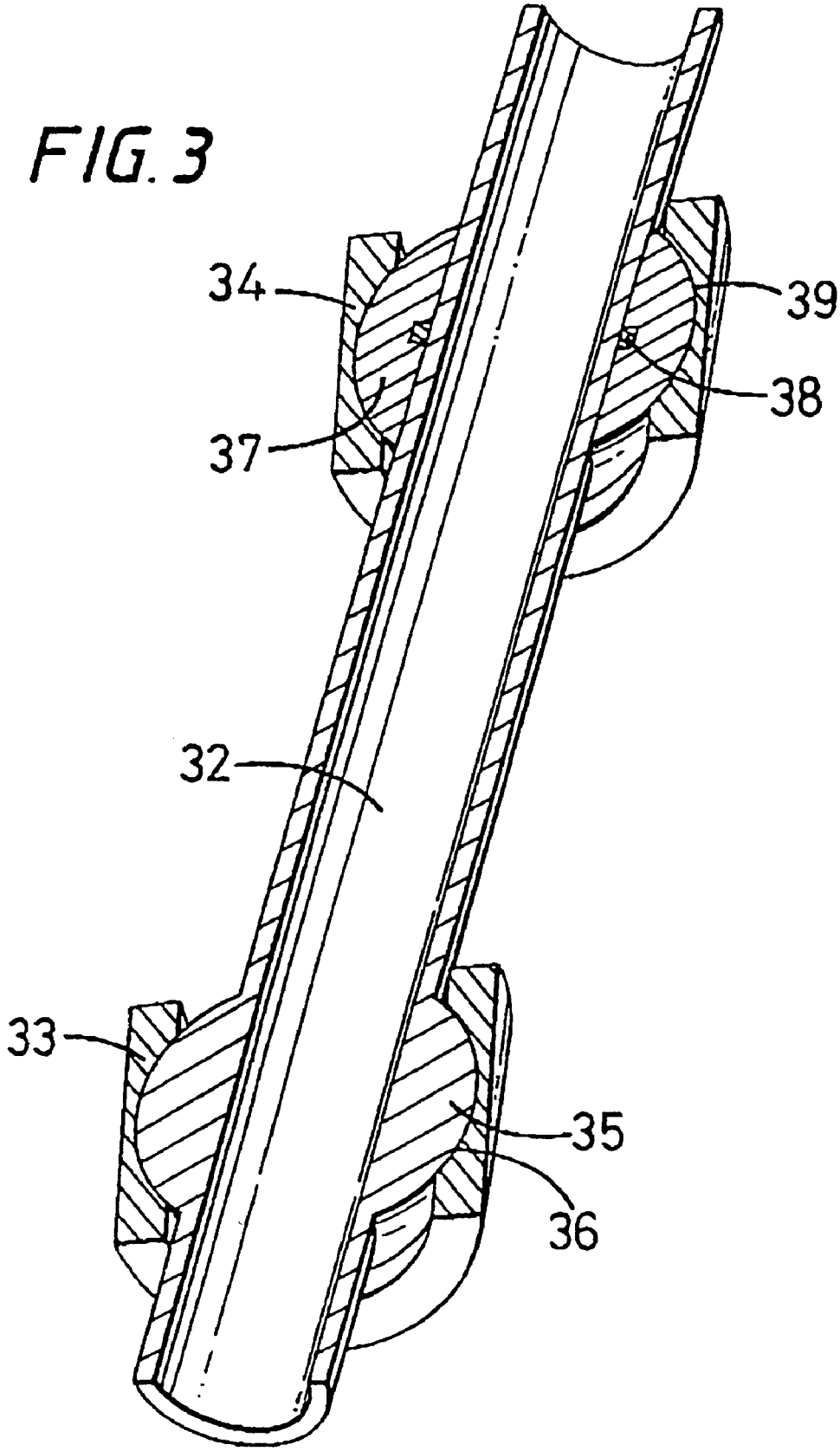
FIG. 3 is an enlarged cross-sectional view in perspective of part of the apparatus of FIG. 1.

A mud pipe 32 is provided between the plate 11 and the supporting member 24 for carrying mud to the inside of a tubular therebelow. The mud pipe 32 is located in cylindrical sections 33 and 34 which are attached to the plate 11 and the supporting member 24. The mud pipe 32 is provided with a lobe 35 formed on the outer surface thereof and is located in a corresponding recess 36 in a cylindrical section 33 (FIG. 3). A lobe 37 is slidably arranged on the lower end of the mud pipe 32 with an O-ring seal 38 arranged therebetween to inhibit fluid from leaking therebetween. The lobe 37 is located in a corresponding recess 39 in cylindrical section 34. This arrangement allows a ball and socket type movement between the plate 11 and the supporting member 24 and relative longitudinal movement therebetween.

Referring back to FIG. 2, a tool 4 for gripping a tubular is fixed and depends from the supporting member 24 of the apparatus 1. Such a tool may be arranged to be inserted into the upper end of the tubular, with gripping elements of the tool being radially displaceable for engagement with the inner wall of the tubular so as to secure the tubular to the tool.

In use, a tubular 40 to be connected to a tubular string held in a spider (not shown), is located over the tool 4. The tool 4 grips the tubular 40. The apparatus 1 and the tubular 40 are lowered by moving the top drive so that the tubular 40 is in close proximity with the tubular string held in the spider. However, due to, amongst other things, manufacturing tolerances in the tubular 40, the tubular often does not align perfectly with the tubular held in the spider. The apparatus 1 allows minor vertical and horizontal movements to be made. The piston and cylinders 28 and 29 allow vertical movement, and may be controlled remotely. The piston and cylinders 28 and 29 may be of the pneumatic compensating type, i.e. their internal pressure may be adjusted to compensate for the weight of the tubular 40 so that movement of the tubular may be conducted with minimal force. Pneumatic compensating piston and cylinders also reduce the risk of damage to the threads of the tubulars. This can conveniently be achieved by introducing pneumatic fluid into the piston and cylinders 28 and 29 and adjusting the pressure therein. The piston and cylinders 28 and 29 may be hydraulic or may be hydraulic and provided with pneumatic bellows.

Tubular manipulating equipment such as stabbing guides may be used to direct the pin (not shown) of the tubular 40 into the box of the tubular string held in the spider. The apparatus I allows horizontal movement of the tubular 40 relative to the top drive 3. Once the tubular 40 is in line with the tubular string, the top of the tubular 40 may be brought in line with the top drive which may be carried out with pipe handling equipment. The top drive 3 is now in direct alignment with the tubular string held in the spider, and can now rotate the apparatus 1 and hence the tool 4 and the tubular 40 to perfect a connection between the tubular 39 and the tubular string.

Figure 4:
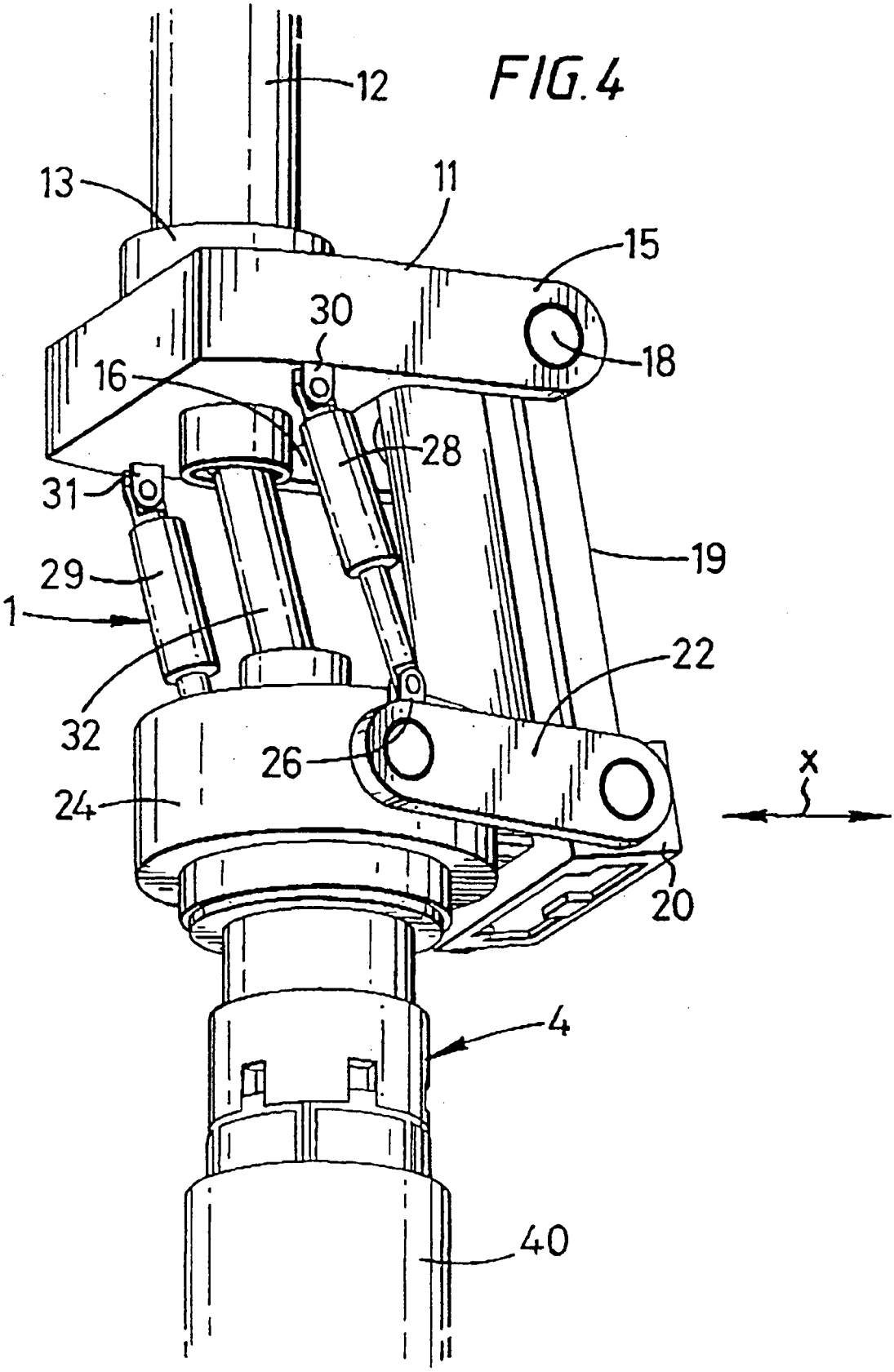
FIG. 4 is an enlarged view of parts of the supports of FIG. 1 in a displaced position.

FIG. 4 shows the supporting member 24, the tool 4 and the tubular 40 laterally in a 'Y' direction out of alignment with the top drive 3. The mud pipe 32 has moved in recesses 36 and 39 and longitudinally in relation to O-ring seals 38. The piston and cylinders 28 and 29 have moved about lugs 26, 27, 30 and 31. Arms 22 and 22' have moved about spherical bearings 23, 23', 25 and 25'.

Figure 5:
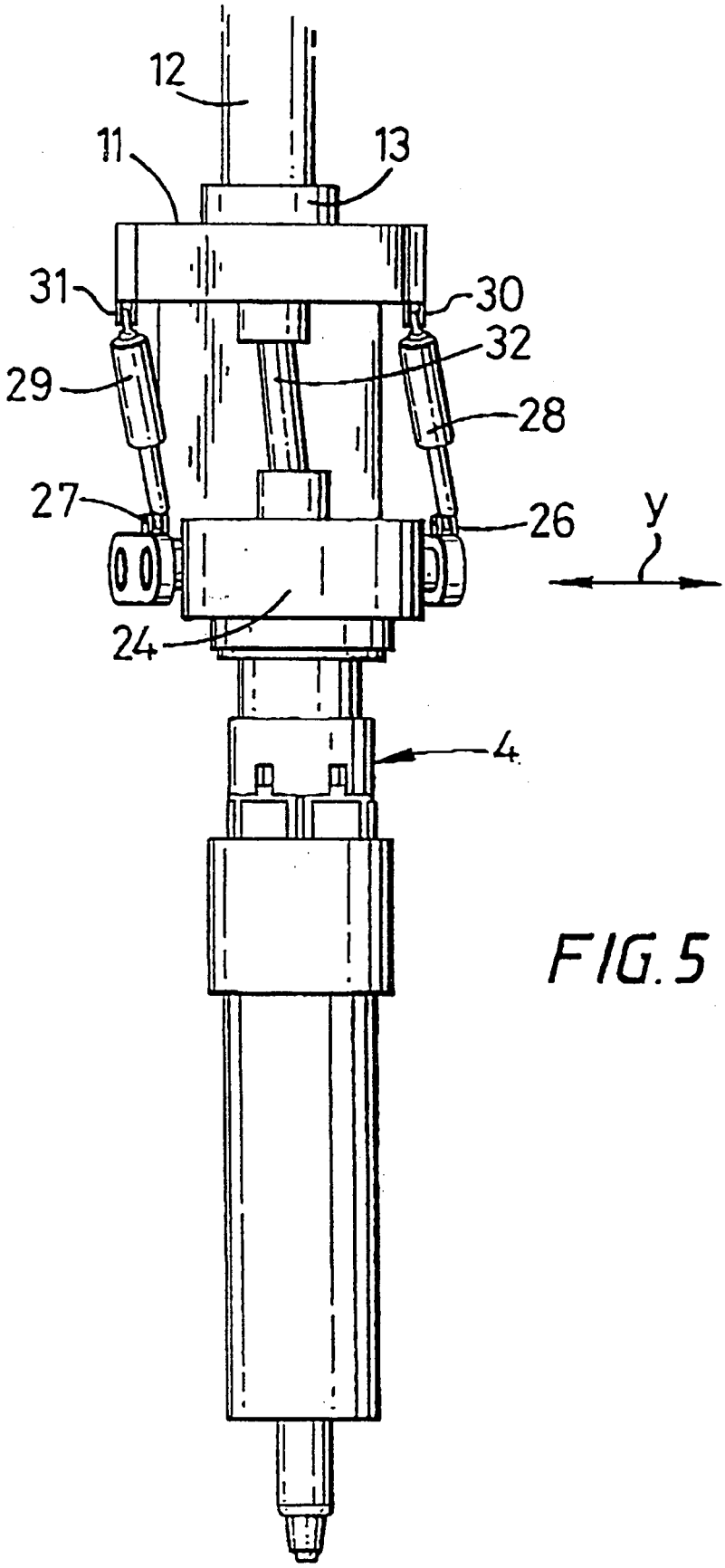
FIG. 5 is an enlarged view of parts of the apparatus of FIG. 1 in a second displaced position.

FIG. 5 shows the supporting member 24, the tool 4 and the tubular member 40 laterally in an ~x' direction. The mud pipe 32 has moved in recesses 36 and 39 and longitudinally in relation to O-ring seals 38. The piston and cylinders 28 and 29 have moved about lugs 26, 27, 30 and 31. Rigid member 19 has moved about axles 18 and 18' and spherical bearings 23.

Figure 6:
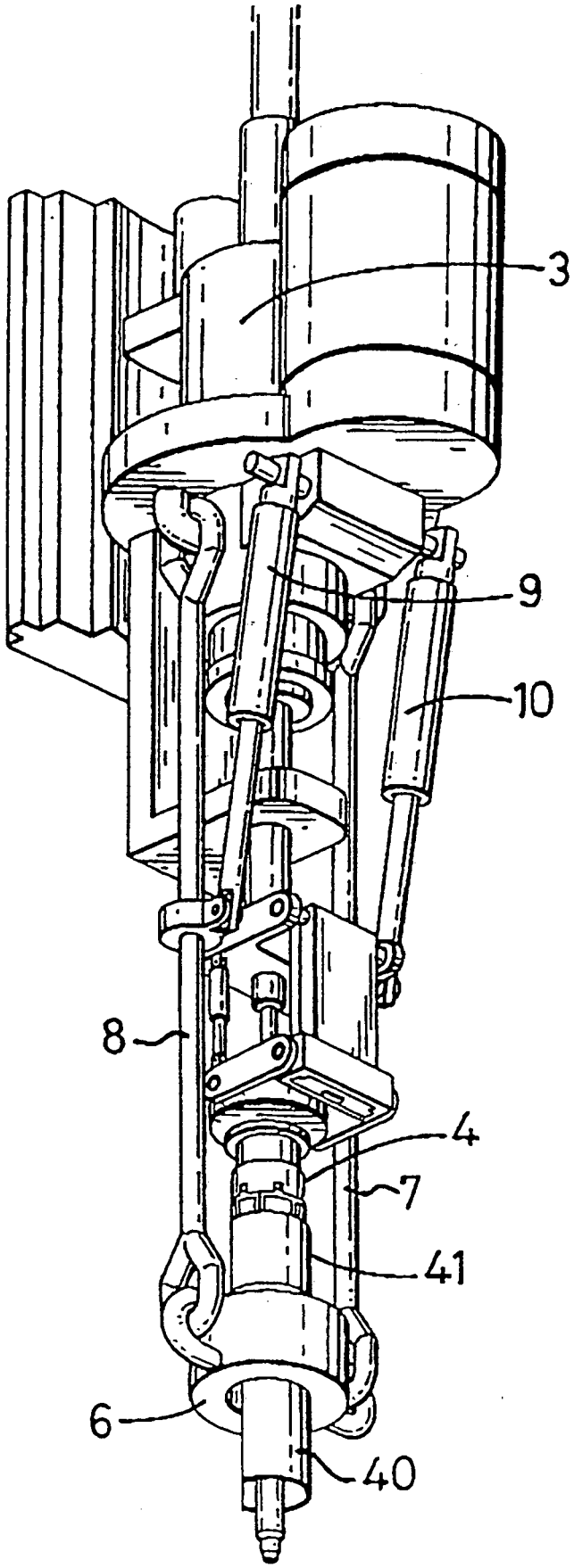
FIG. 6 shows the apparatus of FIG. 1 in a further stage of operation.

FIG. 6 shows the elevator 6 swung in line with the top drive 3 by rotation of the piston and cylinders 9 and 10 acting on bails 7 and 8. The elevator 3 is located below a box 41 of tubular 40. The tubular 40 may be released from engagement with the tool 4. The elevator 6 may now be raised to take the weight of the tubular 40 and tubular string. The tubular string may now be lowered into the well.

Figure 7:
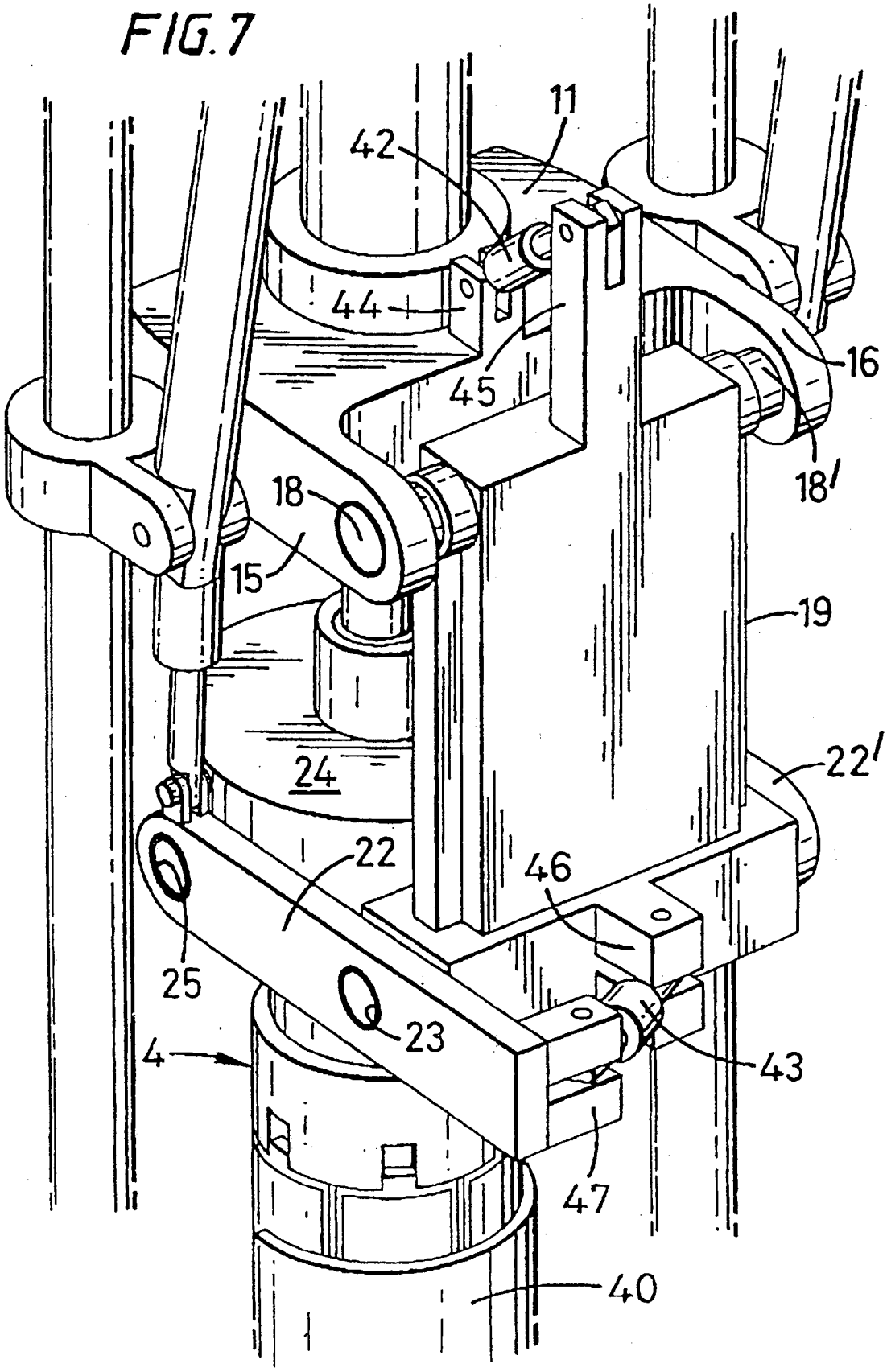
FIG. 7 shows a second embodiment of the present invention.

FIG. 7 is a second embodiment of the present invention and is generally similar to that of FIGS. 1 to 6 further incorporating adjusting piston and cylinders 42 and 43 so that actuation of the piston and cylinders 42 and 43 can move the supporting member 24, the tool 4 and the tubular 40 depending therebelow in a horizontal plane in an x and y axis.

The piston and cylinder 42 is arranged between the plate 11 and the rigid member 19 on lugs 44 and 45. Actuation of the piston and cylinder 42 moves the supporting member 24, the tool 4 and the tubular 40 along a generally x-axis about axles 18 and 18'.

The piston and cylinder 43 is arranged between an extension of arm 22 and slider 20 on lugs 46 and 47. Actuation of the piston and cylinder 43 moves the supporting member 24, the tool 4 and the tubular 40 along a generally y-axis about spherical bearings 23, and 25 and the corresponding spherical bearings arranged in arm 22'.

The piston and cylinders 42 and 43 may be hydraulically of pneumatically operable and may be controlled via a remote control unit (not shown).

In use, a tubular 40 may be gripped by the tool 4 in the way described above and lowered into close proximity with the tubular string held in a spider. The adjusting piston and cylinders 42 and 43 may then be actuated to obtain alignment of the pin of the tubular 40 with the box of the tubular string held in the spider. The tubular 40 may then be rotated to obtain a partial connection or be held in alignment with an additional tool. The piston and cylinders 42 and 43 may then be returned to their original positions to obtain alignment with the top drive 3. The top drive 3 may then be used to torque the connection up to a predetermined torque to complete the connection.

It is envisaged that various modifications may be made to the above described embodiments, such as using a hydraulic motor in place of the supporting member 24.

What is claimed is:

1. An apparatus for facilitating the connection of tubulars using a top drive, the apparatus comprising:

a plate attachable to said top drive, a supporting member for supporting a tool and coupling said tool to said top drive, whereby said tool is rotatable by said top drive, and a motive member for allowing substantially horizontal movement of said supporting member.

2. An apparatus as claimed in claim 1, wherein said motive member allows substantially vertical movement of said supporting member.

3. An apparatus as claimed in any of claim 2, wherein said motive member comprises pistons and cylinders arranged between said plate and said supporting member to allow vertical movement of said supporting member.

4. An apparatus as claimed in any of claim 2, further comprising a slider to facilitate vertical movement of said supporting member.

5. An apparatus as claimed in claim 1, wherein said motive member comprises a rigid member arranged between said plate and said supporting member and arranged on at least one axle.

6. An apparatus as claimed in claim 1, wherein a fluid conduit is arranged between said plate and said supporting member.

7. An apparatus as claimed in claim 6, wherein said fluid conduit is moveable in relation to said plate and said supporting member.

8. An apparatus as claimed in claim 1, wherein said supporting member is a hydraulic motor.

9. An apparatus as claimed in claim 1, wherein said supporting member is integral with said tool.

10. An apparatus as claimed in claim 1, wherein said tool is for gripping a tubular.

11. The apparatus of claim 1, wherein said motive member couples the plate to the supporting member.

12. A method for facilitating the connection of a first tubular to a second tubular using a top drive, the method comprising:

attaching a tool to the top drive using a supporting member;

engaging the first tubular with the tool;

adjusting the supporting member to cause the tool to be displaced horizontally relative to the top drive; and operating the top drive to rotate the first tubular relative to the second tubular.

13. The method of claim 12, wherein adjusting the supporting member comprises adjusting pistons and cylinders arranged between the supporting member and a plate attachable to the top drive.

14. The method of claim 12, further comprising transferring a torque from the top drive to the tool.

15. The method of claim 14, further comprising engaging a first tubular with the tool and rotating the tool to connect the first tubular to a second tubular.

16. The method of claim 12, wherein displacing the tool horizontally aligns a first tubular with a second tubular.

17. The method of claim 12, further comprising engaging an interior portion of a tubular with the tool.

18. A top drive system comprising:

a top drive;

a tubular gripping apparatus; and a structural intermediate operatively coupling the tubular gripping apparatus to the top drive, wherein the structural intermediate is adapted to allow the tubular gripping apparatus to move horizontally relative to the top drive and allow the tubular gripping apparatus to be rotated by the top drive.

19. The top drive system of claim 18, wherein the structural intermediate includes a fluid conduit for fluid communication between the top drive and the tubular gripping apparatus.

20. The top drive system of claim 18, wherein the structural intermediate comprises a first support member connectable to the top drive and a second support member connectable to the tubular gripping apparatus, wherein the second support member is horizontally movable relative to the first support member.

21. The top drive system of claim 18, wherein horizontal movement of the tubular gripping apparatus comprises moving the tubular gripping apparatus away from a central axis of the top drive.

22. The top drive system of claim 18, wherein the horizontal movement is in a substantially horizontal plane.

23. An apparatus for facilitating the connection of tubulars using a top drive, the apparatus comprising:

a plate attachable to said top drive, a supporting member for supporting a tool, and a means for allowing substantially horizontal movement of said supporting member, the means comprising:

a rigid member arranged between said plate and said supporting member and arranged on at least one axle, and at least one arm arranged between said rigid member and said supporting member and connected thereto by spherical bearings.

24. A top drive system, comprising:

a top drive;

a tubular gripping apparatus; and a connector operatively coupling the tubular gripping apparatus to the top drive, wherein the connector is adapted to allow the tubular gripping apparatus to move horizontally relative to the top drive and allow the tubular gripping apparatus to be rotated by the top drive.

* * * * *